US005361441A

United States Patent [19]

Williamson

[11] Patent Number: 5,361,441

[45] Date of Patent: Nov. 8, 1994

[54] ROAD-SWEEPING MACHINE

[75] Inventor: Harry L. Williamson, Franklin, Ky.

[73] Assignee: Schwarze Industries, Inc., Huntsville, Ala.

[21] Appl. No.: 44,177

[22] Filed: Apr. 8, 1993

[51] Int. Cl.[5] ..... E01H 1/04

[52] U.S. Cl. ..... 15/84; 15/83; 414/345

[58] Field of Search ..... 15/84, 83; 198/607, 198/626.2, 688.1, 690.2, 699.1, 846, 847; 414/528, 502, 503, 505, 345

[56] References Cited

U.S. PATENT DOCUMENTS

| | | | |
|---|---|---|---|
| 426,073 | 4/1890 | Sawyer . | |
| 435,144 | 8/1890 | Batt . | |
| 480,231 | 8/1892 | Bruso . | |
| 971,661 | 10/1910 | Brooks . | |
| 998,745 | 7/1911 | Cable . | |
| 1,673,780 | 6/1928 | Sargent . | |
| 1,800,824 | 4/1931 | Evans . | |
| 3,447,179 | 6/1969 | Copeland | 15/84 |
| 3,513,498 | 5/1970 | Bennich | 15/84 |
| 3,521,322 | 7/1970 | Michael | 198/846 |
| 3,728,849 | 4/1973 | Lundahl | 414/528 |
| 3,783,990 | 1/1974 | Siciliano | 198/690.2 |
| 3,938,212 | 2/1976 | Krier et al. . | |
| 4,425,995 | 1/1984 | Blatterman | 198/626.2 |
| 4,550,465 | 11/1985 | Chrisley | 15/84 |
| 4,754,521 | 7/1988 | Zoni | 15/84 |
| 5,178,221 | 1/1993 | Hamawaki | 198/626.2 |

*Primary Examiner*—David A. Scherbel
*Assistant Examiner*—Terrence R. Till
*Attorney, Agent, or Firm*—Cushman, Darby & Cushman

[57] ABSTRACT

A road-sweeping machine designed to be towed behind a truck for removing road debris, including motor vehicle tires and tire fragments, includes a brush assembly that engages the roadway surface and sweeps debris from the roadway onto a first conveyor belt that transports the debris away from the brush. The debris is then constrained between the first conveyor and a second conveyor for delivery to debris receptacle. Both conveyor belts are entrained about a series of rollers supported by related frame structures including rollers mounted on pivotable links that allow the two confronting conveyor belts to move toward and away from one another in response to the size of the debris being constrained between the two conveyors. The tension on the self-adjusting conveyor belts is controlled by a pivotally mounted roller that maintains tension on both belts while self-repositioning in response the separation between the belts caused by the size of the debris being accommodated.

10 Claims, 3 Drawing Sheets

ROAD-SWEEPING MACHINE

BACKGROUND OF THE INVENTION

The present invention relates to road-sweeping machines and, more particularly, to road-sweeping machines designed to sweep debris of varying size, including vehicle tires and fragments thereof, from road surfaces.

Common highway debris includes consumer packaging, bottles, cans, and paper and plastic materials. Additionally, common road debris includes fragments of automobile and truck tires that are left on the road surface because of accident, delamination and fragmentation of re-treaded tires, blowouts, and similar misadventures. The tire fragments can include long strips of delaminated tread, rubber "chunks" of varying size, portions of the sidewall, irregularly shaped and sized portions of the bead and sidewall, and fragments with a multitude thin steel strands extending from the rubber compound. Occasionally, intact passenger car and truck tires are intentionally discarded on the roadway surface.

Highway debris is unsightly and, in the case of tires and tire fragments, an acknowledged road hazard. The governmental agencies responsible for highway maintenance have developed various strategies for the collection of highway debris. At the most basic level of maintenance, collection trucks and their crews patrol assigned areas with the crews manually picking-up and removing larger pieces of debris. As can be appreciated, the crews and their vehicles are exposed to on-going traffic as part of their work, and the capital and labor costs associated with debris collection can be relatively high in view of the amount of material that is collected.

Various types of machines have been designed to remove debris from roadways used by motor vehicles. In general, these designs include machines that can be towed behind a truck and designs that include their own engine and drive train. Many prior designs use some type of cylindrical brush that engages the road surface and which is rotated to brush road debris from the road surface onto a conveyor for delivery into a receptacle. In some cases, a second conveyor belt confronts the debris-carrying belt to effectively capture the debris between the two belts as it is transported to the debris receptacle.

In general, prior art road sweepers are reasonably effective in removing smaller, lightweight debris that falls below a recognized size and weight limit, such debris being represented by bottles, cans, paper goods, and plastics. However, prior art machines are generally not adept at sweeping large irregularly shaped debris, such as tire fragments, or entire tires, from the road surface. Tire fragments and tires represent a particular problem since the debris can vary in size from a few centimeters to a meter or more and can vary in weight from a few ounces to many pounds (in the case of an intact truck tire). Additionally, many tire fragments do not have a substantial shape-sustaining characteristic, for example, long strip-like sections of delaminated treads. Lastly, any high-strength steel strands in the bead and in the tread portion of a tire fragment can interfere with the mechanical components of prior art sweepers.

SUMMARY OF THE INVENTION

In view of the above, it is an object of the present invention, among others, to provide a road-sweeping machine that is well suited to sweeping debris from road surfaces.

It is another object of the present invention to provide a road-sweeping machine that can sweep large, irregularly shaped debris, particularly tire fragments, from road surfaces.

It is still another object of the present invention to provide a road-sweeping machine that can sweep large debris, including intact passenger and truck tires, from road surfaces.

In view of these objects, and others, the present invention provides a road-sweeping machine designed to be towed behind a truck and which removes debris, including motor vehicle tires and fragments thereof, from the roadway. In accordance with the present invention, a rotatable brush engages the roadway surface and sweeps debris from the roadway onto a first conveyor belt that transports the debris away from the brush. A second conveyor belt confronts and overlays the first conveyor belt to capture the debris between the belts. At least one of the belts is entrained over tension-maintaining rollers, including one or more self-repositioning rollers that self-reposition to accommodate debris of different sizes. One of the belts is provided with a much lower surface coefficient of friction than the other belt so that one belt will slip against the other belt to prevent excessive friction and wear between the belts.

In a preferred embodiment of the present invention, a pair of cylindrical brushes are mounted for engagement with the road surface with the forward brush moving debris toward the rear brush so that debris is "picked" from the road surface by the co-action of the brushes. The two brushes are of sufficient diameter and spacing to accommodate the largest expected road debris, including intact truck tires. The debris is deposited onto a first conveyor and then constrained or "captured" between the first conveyor and a second conveyor for delivery to the debris receptacle. Both conveyor belts are entrained about a series of rollers supported by related frame structures. The frame structure of at least one of the conveyors is connected to the support frame of the other by pivotable links that allow the two confronting conveyor belts to move toward and away from one another in response to the size of the debris being constrained between the two conveyor belts. The tension on the self-adjusting conveyor belts is controlled by a pivotally mounted roller that maintains tension on both belts while self-repositioning in response to the separation between the belts caused by the size of the debris being accommodated.

In the preferred embodiment, the two belts are driven at the same linear speed, and the confronting surfaces of the two belts are provided with a relative difference in surface friction. In this situation, the smoother, lower friction belt tends to slip relative to other belt. This relative slippage minimizes the opportunity for the confronting surfaces of the belts to "work" against each other. The two conveyors transport the debris to a debris-receiver, such as the load-carrying bed of a dump truck used to tow the sweeping machine.

The present invention advantageously provides a road-sweeping machine that accommodates debris of differing size and is particularly adept at sweeping passenger vehicle and truck tires and fragments thereof from the road surface.

Other objects and further scope of applicability of the present invention will become apparent from the detailed description to follow, taken in conjunction with the accompanying drawings, in which like parts are designated by like reference characters.

DESCRIPTION OF THE PREFERRED EMBODIMENT

Figure 1:
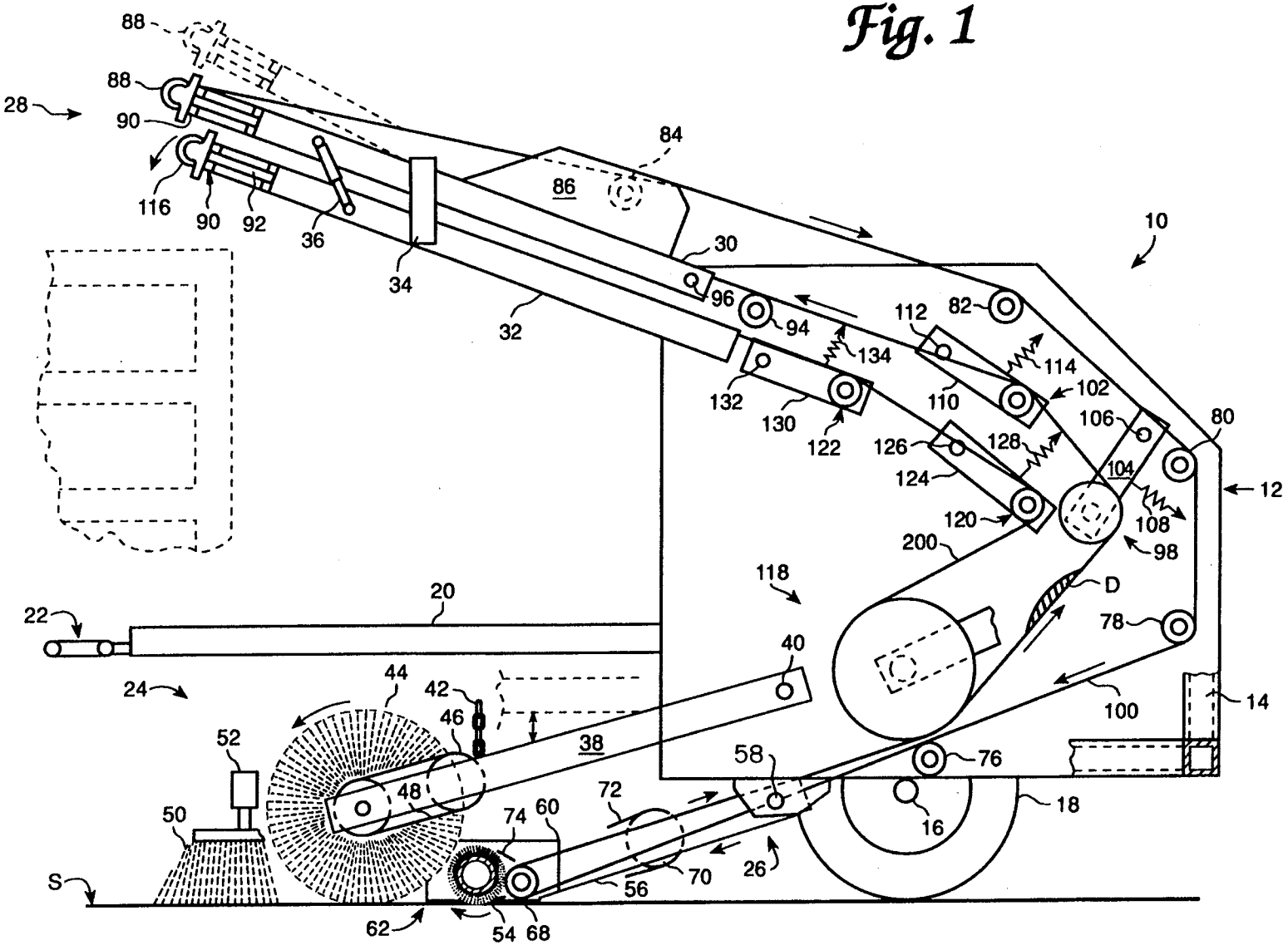
FIG. 1 is a side-elevation view, in cross-section, of a road-sweeping machine in accordance with the present invention with selected portions broken away or shown in schematic form for reasons of clarity.

A road-sweeping machine in accordance with the present invention is shown in FIG. 1 and designated generally therein by the reference character 10. As shown, the sweeping machine 10 is formed from a wheeled chassis 12 that includes a frame assembly 14. In the preferred embodiment, the frame assembly 14 is formed as a box-like weldment from rectangular structural steel tubes (as illustrated on the lower right in FIG. 1) and sheet steel that encloses open portions of the frame structure. In FIG. 1, the frame assembly 14 is shown in pictorial cross-section to reveal interior components. As shown, the frame assembly 14 is mounted upon and above an axle assembly 16 upon which road-engaging wheels 18 are mounted (only one wheel being shown). A trailing arm 20 is secured to the forward portion of the frame assembly 14 and includes a hitch 22 at the forward end thereof for connection to the hitch mount (not shown) of a dump truck. The trailing arm 20 is typically formed from diverging structural members to form an "A-arm" configuration when seen in plan view. In FIG. 1, the upper rear portion of the load-carrying bed (unnumbered) of a dump truck is shown in dotted-line illustration. A brush assembly 24 is mounted forwardly of the frame assembly 14 and carries several brushes, described in more detail below, for sweeping debris from the road surface S. The debris removed from the roadway is transported into the load-carrying bed of the dump truck by a multi-conveyor system described more fully below. The conveyor system includes an under-chassis extension 26 that cooperates with the brush assembly 24 to carry debris from the brush assembly 24. The conveyor system also includes a conveyor discharge end 28 defined by an upper conveyor extension 30 and an associated lower conveyor extension 32 that cooperate to discharge the collected debris into the load-carrying bed of the truck. The upper conveyor extension 30 is pivotally mounted to the frame assembly 14 and can move between its solid-line position and its dotted-line position (partially illustrated) to accommodate debris of varying size, including passenger and truck tires. In the preferred embodiment, the distal end of the upper conveyor extension 30 can rise up to 30 cm. (12 in.) above the distal end of the lower conveyor extension 32. An upwardly extending upper extension guard 34 is mounted, as by welding, to each side of the lower conveyor extension 32 and serves to limit side-to-side movement of the upper conveyor extension 30 while it is moving vertically between its solid and dotted-line positions. A shock absorber 36 is connected between the upper conveyor extension 30 and the lower conveyor extension 32 to dampen the relative movement between these two structures.

The sweeping machine 10, in its preferred embodiment, is powered by hydraulic motors which receive pressurized hydraulic fluid from the towing vehicle through appropriate hoses. In the various figures, the hydraulic motors are represented in schematic form, the individual hydraulic connections and hoses (not shown) being conventional. All the hydraulic motors are connected in series circuit with the hydraulic system of the truck. In general, the truck system is of the type that increases the hydraulic fluid flow rate in a manner proportional to truck speed. In the preferred embodiment, the truck provides a maximum flow of about nine gallons/minutes at a preferred speed of 12 mph with lower truck speeds causing a proportionally lower flow rate.

The brush assembly 24 includes two spaced, parallel brush support arms 38 that are pivotally connected to the frame assembly 14 at respective pivots 40. The brush support arms 38 (and their connected brush structures) are pivotally movable between a lower, operative position and an upper, inoperative position. The brush assembly 24 can be raised or lowered with an elevation controlling cable or chain 42 connected to a hydraulic cylinder(s) or other actuators (not shown), as is known in the art. The elevation controlling cable or chain 42 and its actuator are also used to adjust the elevation of the brushes, described below, above the road surface S.

A primary brush 44 is rotatably mounted at the forward, distal end of the brush support arms 38 and is driven by a hydraulic motor 46 through a chain and sprocket drive 48 and includes a multitude of flexible radially extending bristles (unnumbered). In the preferred embodiment, the cylindrical primary brush 44 is about 61 cm. (24 in.) in diameter and about 168 cm. (66 in.) wide. The primary brush 44 is typically fabricated from a 15 cm. (6 in.) core tube from which the flexible bristles extend in a radial direction. A suitable brush is available from the Danline Corp., 137 North Ave., Kenworth, N.J. The primary brush 44 is driven by its hydraulic motor 46 in a counterclockwise direction (as viewed in FIG. 1) at a rotational speed sufficient to provide a tip velocity about 50% higher than the linear towing speed of the truck and the sweeping machine 10. For example, if the dump truck tows the sweeping machine 10 at a speed of 10 mph, the primary brush 44 is preferably rotated at a speed sufficient to provide a tangential tip velocity of about 15 mph. In the case of a 61 cm. (24 in.) primary brush 44, a rotational speed of about 215 rpm is adequate for a 10 mph linear speed. In the preferred embodiment, side brushes 50 are mounted on each side and forwardly of the primary brush 44 and are designed to brush debris immediately adjacent the primary brush 44 into the path of the primary brush 44 to thereby increase the swept path. The side brushes 50 are of conventional design and are mounted to the brush support arm 38 by supporting structure (not specifically shown). A hydraulic motor 52 is directly connected to each side brush 50 and rotates its respective side brush 50 about the vertical axis in a speed range of between 100 and 200 rpm to brush debris into the path of the primary brush 44.

A secondary brush 54 is mounted at the forward end of the under-chassis extension 26, immediately adjacent the primary brush 44. The under-chassis extension 26 includes spaced, parallel extension arms 56 pivotally mounted to the frame assembly 14 at a pivot connection 58 for movement between a lower, operative position and an upper inoperative position. The extension arms 56 can be mechanically connected to the brush support arm 38 by a flexible cable, chain, or other linkage (not specifically shown) so that the under-chassis extension 26 can be raised and lowered by the same mechanism (not shown) that raises and lowers the brush assembly 24. A mounting plate 60 is secured to the forward end of each of the extension arms 56 and carries the rotatably mounted secondary brush 54. In the preferred embodiment, the secondary brush 54 has a diameter of about 15 cm. (6 in.) and a length coextensive with that of the primary brush 44 (i.e., 168 cm.) The secondary brush 54 is fabricated from a (4 in.) diameter core tube with 2.5 cm. (1 in.) bristles extending in the radial direction; the secondary brush 54 can be obtained from the above-mentioned Danline Corp. The secondary brush 54 is mounted immediately adjacent the rear of the primary brush 44, preferably with an interbrush nip 62 of about 5.0 cm. (3.0 in.). The secondary brush 54 is driven in a clockwise direction at a rotational speed that provides a tip velocity that is approximately the same as that of the primary brush 44 by a drive arrangement described below. For example, where the sweeping machine 10 is towed at 10 mph, the secondary brush 54 is rotated at about 840 rpm. Driving the primary brush 44 and the secondary brush 54 at rotational speeds that provide approximately the same tip velocity for both brushes provides for the smooth and even transport of the debris through the nip 62. Since the primary brush 44 is mounted on the pivotally mounted brush support arms 38 the bristles of the primary brush 44 are relatively flexible, debris that is much larger than the above-described nip 62 can pass between the brushes. In the preferred embodiment, the secondary brush 54 is positively driven via a chain and sprocket drive arrangement described more fully below. While not specifically shown, an adjustable gagewheel is connected to each mounting plate 60 and is adjusted to raise the lower edge of the mounting plate 60 and the lowermost portion of the secondary brush 54 above the surface S of the roadway by a selected distance, for example, 1.5 or 2 cm. (one-half to two-thirds of an inch). The secondary brush 54 is preferably kept off the road surface S by a small amount to reduce dust formation and brush wear.

Figure 5:
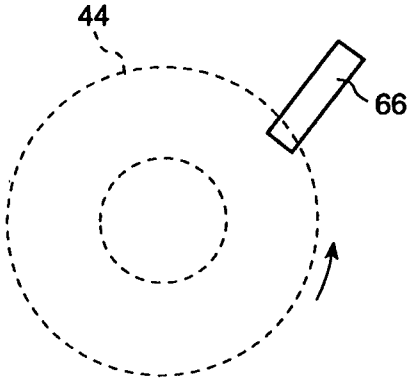
FIG. 5 is a side view, in cross-section, of the debris stripper of FIG. 4 and taken along line 5—5 of FIG. 4.
Figure 4:
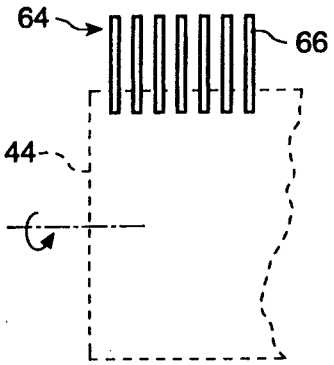
FIG. 4 is a partial front elevational view of a debris stripper.

The brush assembly 24 is provided with a debris stripper 64, shown in partial front elevation in FIG. 4 and in side view in FIG. 5. In practice, many tire fragments include high-strength steel cables in their bead portions and steel belts woven from thin, high-strength steel strands in their tread portion. Oftentimes, steel strands of irregular length and alignment can extend 10 to 20 cm. or more from the fragment and can wind onto or otherwise ensnare the bristles of the primary brush 44. The debris stripper 64 is formed from spaced, parallel stripper blades 66 that includes a lower end that extends into the bristles of the primary brush 44 to effectively force any entangling wires out of ensnarement with the bristles.

Figure 2:
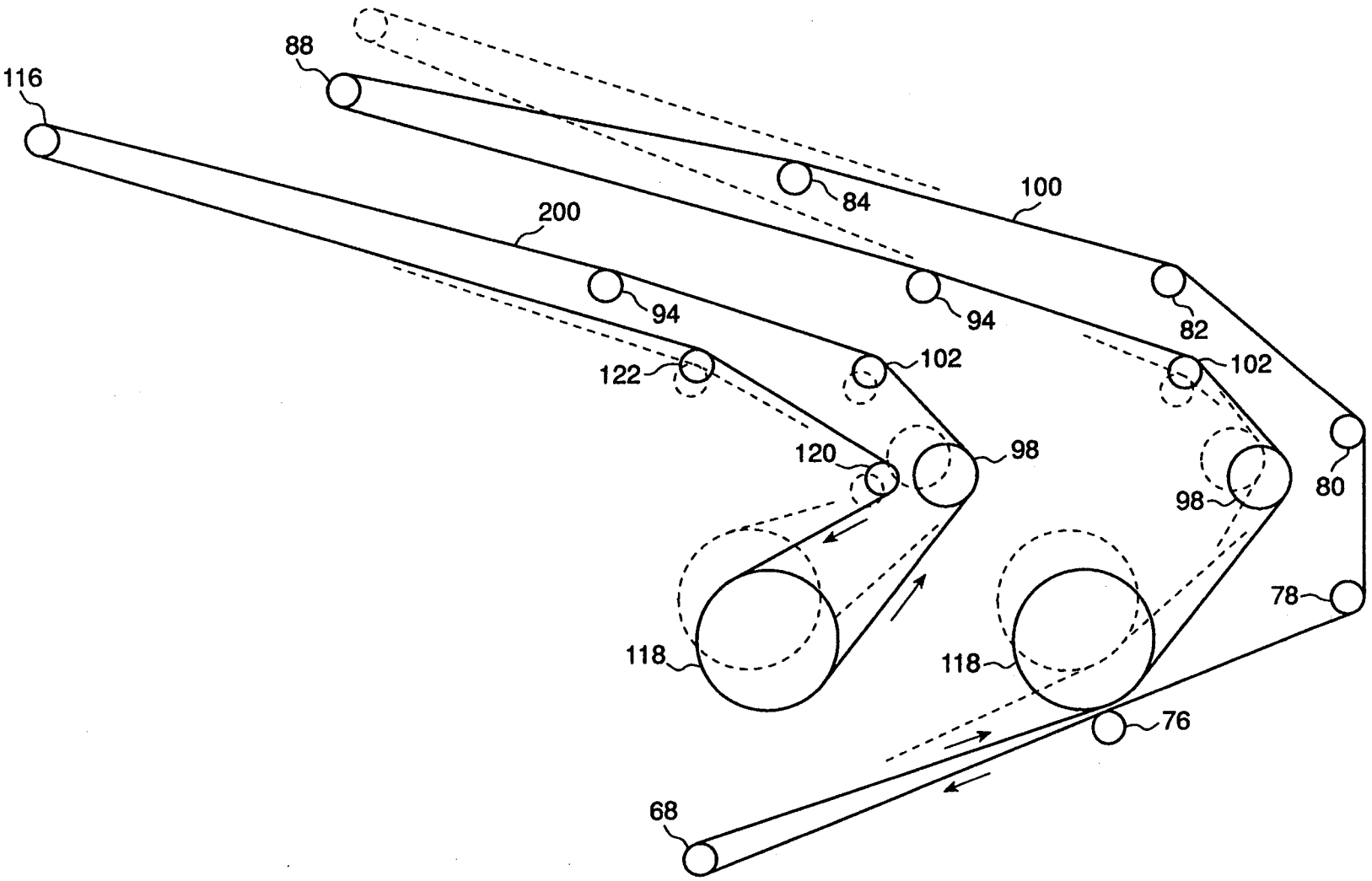
FIG. 2 is a diagramatic side view of first and second conveyers shown in FIG. 1 with the conveyors spaced from one another for reasons of clarity.

The conveyor system includes a first conveyor belt 100 and a second, confronting conveyor belt 200 that serve to transport collected debris from the brush assembly 24 into the debris-receiving bed of the dump truck. In FIG. 1, both the first conveyor belt 100 and the second conveyor belt 200 are shown entrained about their respective rollers and in their cooperative relation. In FIG. 2, the first conveyor belt 100 and the second conveyor belt 200 have been shown in a spaced-apart relationship to fully illustrate the entrainment of the conveyor belts about their respective rollers.

The first conveyor belt 100 is entrained about a series of fixed-position and pivotally movable rollers, including rollers that form a part of the pivotally mounted upper conveyor extension 30. A first fixed roller 68 is rotatably mounted at the forward end of the extension arms 56 immediately adjacent, parallel to, and behind the secondary brush 54. The first fixed roller 68 is journalled in bearings in the mounting plates 60 and is of the same side-to-side width as the primary and secondary brushes (168 cm.) and has a medium knurled surface for engagement with the first conveyor belt 100. In the preferred embodiment, the first fixed roller 68 is crowned, that is, has a diameter at its midpoint of about 7.6 cm. (3 in.) that tapers to a diameter of about 7 cm. (2.75 in.) at its opposite ends. The crowned first fixed roller 68 assists in properly training the first conveyor belt 100, as is known in the art. The first fixed roller 68 is driven by a hydraulic motor 70 through a chain and sprocket drive 72 (shown in schematic form). The first fixed roller 68 is driven at a rotational speed sufficient to drive the first conveyor belt 100 at a linear speed in a range of five to eight feet/second in the direction shown. The chain and sprocket drive 72 is additionally connected to the secondary brush 54 by a chain and sprocket drive 74 (shown in schematic form) to drive the secondary brush 54 in a counterclockwise direction at a tip velocity approximately equal to that of the primary brush 44, as described above. Additional fixed rollers include a second fixed roller 76, a third fixed roller 78, a fourth fixed roller 80, and a fifth fixed roller 82 rotatably mounted between the sides of the frame assembly 14. A sixth fixed roller 84 is rotatably mounted between a pair of mounting plates 86 that extend upwardly from the upper conveyor extension 30, and a seventh fixed roller 88 is located at the remote or distal end of the upper conveyor extension 30. The seventh fixed roller 88 is mounted with a telescoping bearing mount 90 that allows the position of the seventh fixed roller 88 to be extended or retracted somewhat by manual adjustment. While the telescoping bearing mount 90 is shown in schematic form, the preferred telescoping bearing mount 90 includes a threaded shaft 92 that can be manually rotated to extend (as shown in dotted-line) or retract the one side of the seventh fixed roller 88 relative to the upper conveyor extension 30 and the opposite side of the seventh fixed roller 88. Lastly, an eighth fixed roller 94 is mounted between the sidewalls of the frame assembly 14 immediately to the right of the upper conveyor extension pivot 96. In addition to the fixed rollers, the first conveyor belt 100 is also entrained about two pivotally mounted rollers, a first pivoted roller 98 and a second pivoted roller 102. As shown, the first pivoted roller 98 is rotatably mounted in the remote end of a pivot arm 104 that is pivotably mounted at pivot 106 and resiliently urged in a counterclockwise direction by a tensioned spring 108. In the preferred embodiment, the first pivoted roller 98 has a diameter of about 20 cm. (8 in.). In a similar manner, the second pivoted roller 102 is rotatably mounted in the remote end of a pivot arm 110 that is pivotably mounted at pivot 112 and also resiliently urged in a counterclockwise direction by a tensioned spring 114. In the preferred embodiment, the second pivoted roller 102 has a diameter of about 10 cm. (4 in.). As shown schematically on the right side of FIG. 2, the pivot arm 104 and the pivot arm 110 can moved between the solid and dotted-line positions to accommodate debris of differing sizes.

As with the first conveyor belt 100, the second conveyor belt 200 is also entrained about a series of fixed-position and pivotally mounted rollers, including the first pivoted roller 98 and the second pivoted roller 102 that also assist in guiding the first conveyor belt 100. A ninth fixed roller 116 is rotatably mounted at the remote or distal end of the lower conveyor extension 32, and, like the seventh fixed roller 88, is mounted with a telescoping bearing mount 90 that allows the position of the ninth fixed roller 116 to be extended or retracted somewhat by manual adjustment to extend or retract the one side of the ninth fixed roller 116 relative to the upper conveyor extension 30 and the opposite side of the ninth fixed roller 116. Additionally, the eighth fixed roller 94 is mounted between the sidewalls of the frame assembly 14 immediately to the right of the upper conveyor extension pivot 96 and serves to support the underside of the second conveyor belt 200 and the overlying first conveyor belt 100. In addition to the ninth fixed roller 116 and the eighth fixed roller 94, the second conveyor belt 200 is also entrained about the first pivoted roller 98 and the second pivoted roller 102 that also entrain the first conveyor belt 100. Additionally, the second conveyor belt 200 is entrained about a primary tensioning roller 118, a third pivoted roller 120, and a fourth pivoted roller 122. The third pivoted roller 120 and the fourth pivoted roller 122 are similar in design to the second pivoted roller 102 described above. The third pivoted roller 120 is rotatably mounted at the distal or remote end of a pivot arm 124 that is pivotally mounted at a pivot 126 and resiliently biased or urged in the counterclockwise direction by a tensioned spring 128. Likewise, the fourth pivoted roller 122 is rotatably mounted at the distal or remote end of a pivot arm 130 that is pivoted at pivot 132 and also resiliently biased or urged in the counterclockwise direction by a tensioned spring 134.

Figure 3:
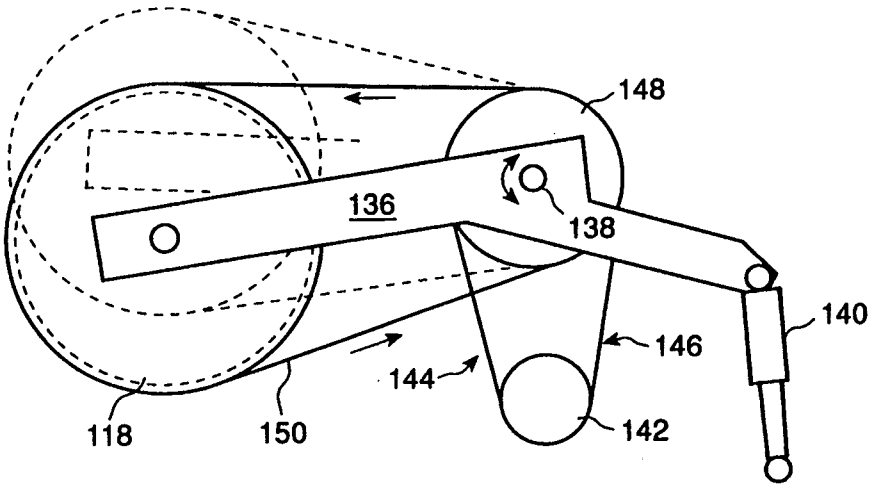
FIG. 3 is a side view of a tensioning roller that tensions the first and second conveyors shown in FIG. 2.

The primary tensioning roller 118 and its related mounting structure is shown in more detail in FIG. 3. As shown, the primary tensioning roller 118 is rotatably mounted at one end of a pair of spaced support arms 136. Each support arms 136 is pivotally connected at a pivot 138 intermediate its ends to the frame assembly 14. The opposite end of the support arm 136 is coupled by a shock absorber 140 to the frame assembly 14 to dampen the motion of the primary tensioning roller 118. The primary tensioning roller 118 is rotatably driven by a hydraulic motor 142 through a chain and sprocket drive 144 that includes a chain 146 connected between the hydraulic motor 142 and a sprocket 148 and another chain 150 connected between the sprocket 148 and an appropriate sprocket (not shown) associated with the primary tensioning roller 118. Since the hydraulic motor 142 is stationary relative to the pivot 138, the primary tensioning roller 118 can be positively driven as the primary tensioning roller 118 self-repositions, as described below. In the preferred embodiment, the primary tensioning roller 118 is driven at a sufficient speed to provide the second conveyor belt 200 with a linear speed about the same as the first conveyor belt 100, i.e., five to eight feet/second. The primary tensioning roller 118 is preferably a crowned, smooth-surfaced roller with a diameter at its mid-point of approximately 46 cm. (18 in.) with the diameter decreasing at a rate of about 3 mm. ($\frac{1}{8}$ in.) per foot from the mid-point towards the respective ends of the primary tensioning roller 118. In practice, a weight of 900 lbs. for the primary tensioning roller 118 has been found to provide appropriate tensioning for the first conveyor belt 100 and the second conveyor belt 200.

As shown in FIGS. 1 and 2, the first conveyor belt 100 is directly engaged by and entrained about the first fixed roller 68 (immediately adjacent and to the rear of the secondary brush 54), the second fixed roller 76, the third fixed roller 78, the fourth fixed roller 80, the fifth fixed roller 82, the sixth fifth roller 84, the seventh fixed roller 88 at the remote end of the upper conveyor extension 30. The first conveyor belt 100 also is entrained and controlled by the eighth fixed roller 94, the second pivoted roller 102, the first pivoted roller 98, and primary tensioning roller 118; the first conveyor belt 100 overlying the second conveyor belt 200 as it is entrained by these latter rollers. The resilient biasing or urging of the first pivoted roller 98 and the second pivoted roller 102 and the tensioning provided by the primary tensioning roller 118 maintain the tension of the first conveyor belt 100 as it travels over its various entraining rollers. As can be appreciated, the hydraulic motor 70 will drive the first conveyor belt 100 (and the secondary brush 54) in its desired linear speed range while the first conveyor belt 100 is concurrently maintained in its desired tensioned state.

The second conveyor belt 200 is directly engaged by and entrained about the eighth fixed roller 94, the ninth fixed roller 116 (at the remote end of the lower conveyor extension 32), the fourth pivoted roller 122, the third pivoted roller 120, and the primary tensioning roller 118. The second conveyor belt 200 also is entrained and controlled by the first pivoted roller 98, the second pivoted roller 102, and the eighth fixed roller 94; the second conveyor belt 200 confronting the first conveyor belt 100 as it is entrained by these latter rollers. The resilient biasing or urging of the primary tensioning roller 118, the third pivoted roller 120, and the fourth pivoted roller 122 maintain the tension of the second conveyor belt 200 as it travels over its various entraining rollers. As can be appreciated, the hydraulic motor 142 will drive the second conveyor belt 200 in its desired linear speed range while the second conveyor belt 200 is concurrently maintained in its desired tensioned state.

The first conveyor belt 100 and the second conveyor belt 200 are designed to confront one another in face-to-face contact as the two belts are entrained about the primary tensioning roller 118, the first pivoted roller 98, the second pivoted roller 102, and the eighth fixed roller 94. The first conveyor belt 100 and the second conveyor belt 200 are provided with different surface coefficients of friction; the first conveyor belt 100 has a relatively "rough" surface that provides somewhat higher coefficient of friction than the smoother surface of the second conveyor belt 200. Since the first conveyor belt 100 and the second conveyor belt 200 are driven at the same linear speed, the confronting surfaces of the two belts will not slip relative one another, except in those portions of the belt paths where one belts follows a somewhat larger radius relative to the other belt. In these situations, the smoother surfaced second conveyor belt 200 will allow for relative slippage between the confronting surfaces of the belts. Such relative slippage can occur principally at the first pivoted roller 98. A suitable belt for the rougher surface first conveyor belt 100 is the PVC 100 (FS) belt, and a suitable belt for the relatively smoother surface second conveyor belt 200 is the PVC 120 (CxC) belt; both belts available from the Belt Service Corporation, St. Louis, Mo.

In operation, the sweeping machine 10 is towed behind a dump truck in a selected speed range, i.e., 8–12 mph, with the remote end of the conveyor discharge end 28 overhanging the rear end of the truck (illustrated in dotted-line in FIG. 1) and with appropriate hydraulic hose connections (not shown) made between the truck hydraulic system and the sweeping machine 10. The primary brush 44 is rotated in a counterclockwise direction by its hydraulic motor 46 and the secondary brush 54 is rotated in the clockwise direction by the hydraulic motor 70, which also drives the first conveyor belt 100. Additionally, each side brush 50 is driven by its hydraulic motor 52 to sweep debris into the path of the primary brush 44. As the truck tows the sweeping machine 10 along the roadway, the primary brush 44 will ride up and upon the debris to sweep the debris toward and into the interbrush nip 62. Since the tip velocity of the primary brush 44 is about 50% higher than the linear speed of the primary brush 44 along the roadway, the primary brush 44 will tend to "flip" the debris toward the nip 62. The secondary brush 54 assists in smoothly pulling the debris upwardly from the road surface S and depositing the debris onto the rougher-surfaced first conveyor belt 100. In general, the relative sizes of the primary brush 44 and the secondary brush 54 and their spacing has proved effective in sweeping tire fragments of varying shape and size, including intact passenger car and truck tires, from the road surface S. Since the primary brush 44 is mounted on the pivotally mounted brush support arm 38, it can ride upon and above relatively large pieces of debris to thereby enlarge the nip 62 between the primary brush 44 and the secondary brush 54 as required. The maximum distention between the primary brush 44 and the secondary brush 54 is such that a complete passenger or truck tire can be removed from the road surface S. The debris exits the interbrush nip 62 and is moved toward and upon the receiving surface of first conveyor belt 100 immediately behind the secondary brush 54. Since the first conveyor belt 100 has a rough, higher-friction surface, any tendency for the debris to slip from the surface of the first conveyor belt 100 is minimized. If any debris tends to wrap or otherwise wind about the primary brush 44, the debris stripper 64 (FIGS. 4 and 5) will be effective to strip the debris from the surface of the primary brush 44 and redirect the debris to receiving surface of the first conveyor belt 100. In practice, the debris stripper 64 is effective to remove ensnared tire-reinforcement strands from the primary brush 44.

The debris is transported rearwardly and upwardly on the first conveyor belt 100 into the frame assembly 14 where it encounters the primary tensioning roller 118 and the confronting second conveyor belt 200. Since the primary tensioning roller 118 is mounted opposite the second fixed roller 76 and is also pivotally mounted, the primary tensioning roller 118 will pivot upward (FIGS. 2 and 3) an appropriate amount to accommodate the debris. During this pivoting movement, tensioning of both the first conveyor belt 100 and the confronting second conveyor belt 200 will be maintained. A shown by the symbolically represented debris D captured between the first conveyor belt 100 and the second conveyor belt 200, the debris D will be transported between the two conveyor belts about the first pivoted roller 98, the second pivoted roller 102, and over the eighth fixed roller 94. As can be appreciated, the first pivoted roller 98 and the second pivoted roller 102 will yield against the restoring force of the tensioned spring 108 and the tensioned spring 114, respectively, to maintain belt tensions. Additionally, one belt will slip against the other as the belts change directions around the first pivoted roller 98. The debris D is then conveyed between the fixed lower conveyor extension 32 and the pivotally mounted upper conveyor extension 30 toward the discharge end 28. As the debris D passes over the ninth fixed roller 116 at the remote end of the lower conveyor extension 32, the upper conveyor extension 30 will pivot upward to accommodate debris of differing shape and size with the relative motion dampened by the shock absorber 36. As can be appreciated from FIG. 1, the path of the debris D reverses from an initially upward and rearward direction to an upward and forward direction just prior to discharge.

The conveyor discharge end 28 is configured so that the remote end of the upper conveyor extension 30 extends further from the frame assembly 14 than the end of the lower conveyor extension 32, for example, by about 13 cm. (5 in.). This overhanging relationship assists in directing the discharged debris downwardly into the bed of the dump truck. The first conveyor belt 100 and the second conveyor belt 200 are configured so that the debris D is discharged in the direction of the forward motion of the towing vehicle, in contrast to those prior art arrangements in which the debris is discharged in the direction opposite to the forward motion of the towing vehicle.

The present invention advantageously provides a road-sweeping machine that is effective in accommodating road debris of varying size and, in particular, tires and tire fragments and is characterized by repositionable rollers that reposition to accommodate the size and shape of the debris while maintaining the tension of the conveyors belts entrained about the rollers.

As will be apparent to those skilled in the art, various changes and modifications may be made to the illustrated road-sweeping machine of the present invention without departing from the spirit and scope of the invention as determined in the appended claims and their legal equivalent.

What is claimed is:

1. A machine for sweeping debris from a roadway, comprising:

a wheeled frame for movement along a roadway in an intended direction;

a brush means supported by said frame and engageable with a roadway surface for brushing debris from the roadway;

a means supported by said frame for conveying debris brushed from the roadway surface to a discharge end from which debris swept from the roadway is discharged, said conveying means including a first conveyor belt for receiving debris from said brush means and a second conveyor belt confronting at least a portion of said first conveyor belt for restraining the debris between the confronting portions of the first and second conveyor belts, said first and second conveyor belts in substantially confronting relationship toward and to said discharge end, said discharge end including a first sub-frame structure for supporting said first conveyor belt and a second sub-frame structure for supporting said second conveyor belt in confronting relationship to said first conveyor belt, said first sub-frame structure pivotally mounted relative to said frame above said second sub-frame to move said first conveyor belt towards and away from said second conveyor belt in response to the size of the debris transported therebetween to said discharge end, a distal end of said pivotally mounted sub-frame structure adjacent said discharge end extending beyond a distal end of said second sub-frame structure; and a conveyor belt support means including a plurality of rollers about which said first and second conveyor belts are entrained and including at least one resiliently biased, repositionable roller that tensions said first and second conveyor belts and re-positions in response to the size of the debris constrained between the confronting surfaces of said first and second conveyor belts.

2. The road-sweeping machine of claim 1, wherein said brush means comprises:

a first rotatable brush extending across a swept path and rotated in a first direction and a second rotatable brush substantially co-extensive with first rotatable brush and separated therefrom by a selected nip-distance and rotated in a direction opposite to said first direction.

3. The road-sweeping machine of claim 2, wherein said first rotatable brush is movably mounted for movement toward and away from the road surface in response to the size of the debris swept from the road surface.

4. The road-sweeping machine of claim 3, wherein said first rotatable brush is rotatably mounted on remote ends of a pair of support arms pivotally mounted to said frame for pivoted movement toward and away from a road surface in response to the size of the debris swept from the road surface.

5. The road-sweeping machine of claim 4, wherein said conveyor system includes a debris-accepting end positioned adjacent said second rotatable brush for receiving debris transported through the interbrush nip.

6. The road-sweeping machine of claim 1, wherein said sweeping machine further comprises means for connecting said frame to a prime mover that includes a debris receptacle for receiving debris from the discharge end of the conveyor system.

7. The road-sweeping machine of claim 6, wherein said sweeping machine is towed behind prime mover.

8. The road-sweeping machine of claim 1, wherein said conveyor means reverses the conveyed direction of the debris from a first direction to a second direction.

9. The road-sweeping machine of claim 1, wherein said conveyor system includes a primary tensioning roller about which one of said conveyor belts is directly entrained, the other of said conveyor belts engaging a portion of the one conveyor belt entrained about said primary tensioning roller, whereby both conveyor belts are tensioned by said primary tensioning roller.

10. The road-sweeping machine of claim 1, the debris-engaging surface of one of said conveyor belts has a higher surface coefficient of friction that the other of said conveyor belts.

* * * * *